United States Patent [19]

Bauer et al.

[11] Patent Number: 4,757,164

[45] Date of Patent: Jul. 12, 1988

[54] PUSHBUTTON SWITCH

[75] Inventors: Karl-Heinz Bauer; Edgar Maisch, both of Bad Neustadt/Saale, Fed. Rep. of Germany

[73] Assignee: Preh Elektrofeinmechanische Werke Jakob Preh Nachf. GmbH & Co., Bad Neustadt/Saale, Fed. Rep. of Germany

[21] Appl. No.: 42,521

[22] Filed: Apr. 24, 1987

Related U.S. Application Data

[63] Continuation of Ser. No. 717,457, Mar. 29, 1985, abandoned.

[30] Foreign Application Priority Data

Mar. 31, 1984 [DE] Fed. Rep. of Germany ..... 3412027

[51] Int. Cl.[4] ..... H01H 1/06; H01H 5/04; H01H 13/56

[52] U.S. Cl. ..... 200/67 A; 200/153 J; 200/68.1; 200/275; 200/340; 200/159 R

[58] Field of Search ..... 200/339, 153 J, 340, 200/308, 67 R, 67 A, 67 PK, 68.1, 68.2, 68.3, 159 R, 153 L, 153 LA, 275

[56] References Cited

U.S. PATENT DOCUMENTS

| | | | |
|---|---|---|---|
| 2,044,065 | 6/1936 | Douglas | 200/68.1 X |
| 2,295,484 | 9/1942 | Krieger | 200/67 A |
| 2,576,771 | 11/1951 | Bently | 200/67 A |
| 2,623,960 | 12/1952 | Haydon | 200/67 A |
| 2,668,204 | 2/1954 | Tregoning | 200/68.1 |
| 3,394,403 | 7/1968 | Dennison | 200/68.1 X |
| 3,521,013 | 7/1970 | Baumanis | 200/67 A |
| 3,789,173 | 1/1974 | Bury | 200/153 J |
| 4,204,102 | 5/1980 | Bull | 200/153 J |
| 4,287,401 | 9/1981 | Rohrbach | 200/308 |
| 4,354,076 | 10/1982 | Lutzenberger | 200/308 |

FOREIGN PATENT DOCUMENTS

| | | |
|---|---|---|
| 2416969 | 10/1975 | Fed. Rep. of Germany . |
| 3046831 | 7/1982 | Fed. Rep. of Germany . |
| 3151501 | 7/1983 | Fed. Rep. of Germany . |

*Primary Examiner*—Henry J. Recla
*Assistant Examiner*—Ernest G. Cusick
*Attorney, Agent, or Firm*—Woodcock Washburn Kurtz Mackiewicz & Norris

[57] ABSTRACT

A pushbutton switch comprising a housing within which a pushbutton can move with respect to a housing socket is described. Within the housing is placed a switch plunger which moves longitudinally and can also pivot through a small angle. A contact bridge, which can be pivoted in an oversprung fashion between two fixed contacts, is disposed in the housing. The placement of the contact bridge is governed by a switch rocker, which is arranged in a hinged fashion in the housing. This allows the switch plunger and switch rocker to engage. The counterbearing for the contact bridge consists of a knife-edge bearing in the switch rocker. Between the switch plunger and the switch rocker is a return spring, arranged so that in the rest position of the pushbutton, the switch plunger occupies a pivoted position remote from the middle position. The cross motion of the switch plunger is halted, depending on the direction of motion of the pushbutton, by a constraining guide on each side.

19 Claims, 5 Drawing Sheets

PUSHBUTTON SWITCH

This is a continuation of application Ser. No. 717,457, filed Mar. 29, 1985, now abandoned.

FIELD OF THE INVENTION

This invention relates to a pushbutton switch.

BACKGROUND OF THE INVENTION

Electrical switches serve to connect or disconnect electrical contacts, and regardless of their construction or operating principle, offer the user of a device control of its operation. As points of intersection between man and machine, switches are indispensable, and have reached a very high level of technology. Furthermore, switches are among the few classes of electromechanical components which are desirably attractive to the eye and touch as well as adequate for the switching function. Since they are often installed on the front panel of a device, switches contribute decisively to its appearance. It is therefore not surprising that an almost incomprehensible variety of rotary switches, rocker switches, toggle switches, slide switches, key switches and pushbutton switches are offered, in every imaginable shape, color and size. The switch described herein belongs to the group of pushbutton switches.

DE-OS 31 51 501 describes a pushbutton switch which consists of a pot-shaped housing, in which a pushbutton moves. Within the pushbutton is a bar projecting into the interior of the switch, around which a switch plunger is mounted so as to swivel and slide. The switch plunger consists of a disc and a wedge-shaped appendage. Independent of the pushbutton and beneath the switch plunger is a switching rocker which is mounted by means of a bearing pin mounted in a bearing shield so as to swivel. This switching rocker is generally T-shaped with a cross-arm and a guide appendage extending perpendicularly downward. The upper surface of the cross-arm is wedge-shaped, to fit the wedge-shaped appendage of the switch plunger. The angle of inclination of the two halves of the wedge is half the swivel angle of the switch rocker. In both switch positions, one wedge half at a time is in the horizontal position. The switch plunger swivels by means of two return springs, which are clamped on different sides of the appendage between the switch plunger and the switch rocker. There is a blind hole in the guide appendage of the switch rocker into which a compression spring fits, which presses against the bottom of the blind hole at one end and against a contact cylinder at the other. The bottom of the housing has two identical roof-shaped, curved control surfaces, along which the contact cylinders can travel.

A further pushbutton switch is described in DE-OS 30 46 831, which shows a pushbutton moving with respect to a rectangular housing. On the upper surface of the pushbutton is a wedge-shaped appendage pointing inwards. The tip of this appendage serves as the rocker bearing for a switch plunger. This consists of a disc and a plunger pointing downwards. The plunger engages the wedge-shaped point of a switch rocker. The switch rocker has on either side a bearing pin, which can turn in a cavity in the housing. The wedge-shaped point is part of one control surface of the switch rocker. The control surface consists of a central peak, two sides falling away from this peak, and two facets projecting from the ends of the sides. The peak has a certain separation from the bearing pins of the switch rocker, so that in either switch position, it lies on either side of a plane defined by the bearing axis and the sliding direction. This ensures that the plunger always is in contact with one of the sides. Between the switch plunger and the switching rocker is a return spring. The pre-tension on the two opposite sides has a different value depending on the angle of the switching rocker. Attached to the switching rocker is a spring-loaded switch pin which presses on a contact rocker, which is pivoted around a fixed contact.

OBJECT OF THE INVENTION

The object of this invention is to further develop a pushbutton switch of the type just described, the improved switch to provide a simple mechanical indication of switch position, and comprising a minimum of components despite its compact design, so as to be economically manufacturable as a mass-market product, and in which the contact pressure will be maintained or increased until just before switching, in order to obtain an extended, useful lifetime.

The preferred embodiment of the invention, which meets the object above, will be described below in more detail with reference to the drawings.

DESCRIPTION OF THE PREFERRED EMBODIMENT

Figure 1:
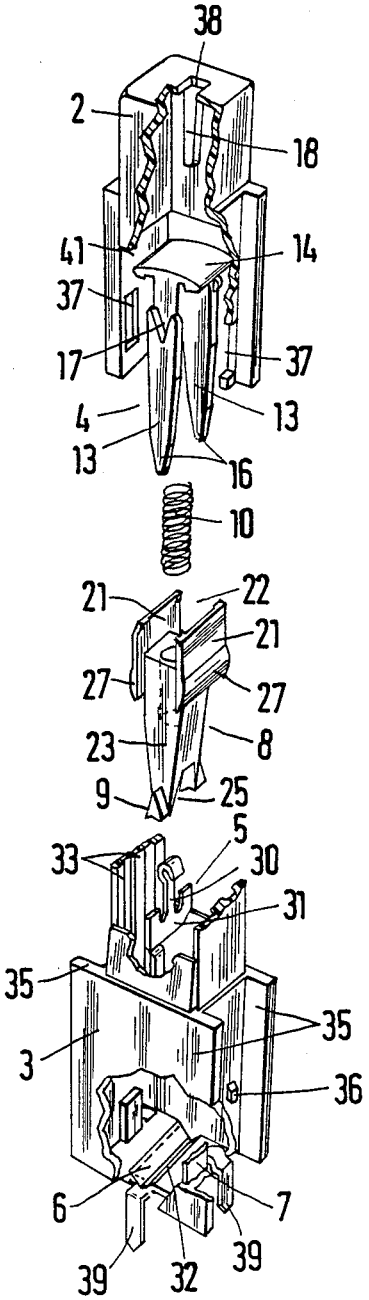
FIG. 1: a perspective side view of a pushbutton switch in exploded view.

The pushbutton switch shown in the figures has a rectangular housing socket 3 made of plastic. A central contact 6 is molded into the pot-shaped housing socket 3 at the center of the bottom of the housing. A fixed contact 7 is molded onto each side of the housing, contacts 6 and 7 being made of an electrically conductive material. Terminal ears 39 project from the bottom of the housing socket. The switch is thus suitable for installation in a printed circuit. The central contact part 6, made of metal, has a V-shaped knife-edge bearing 32, which fits into a similarly V-shaped cavity 40 in the bottom of the housing socket.

As FIG. 1 shows, projecting parallel lateral guide ridges 35 are formed into the four corners of the housing socket 3. In addition, a number of projecting catches 36 are present on the outer surface of housing socket 3. These catches 36 mate with slots 37 which are formed in the pushbutton 2. This rectangular pushbutton is also made of plastic and can move axially with respect to the housing socket 3. The slots 37 are recessed into two resilient side walls 41 of the pushbutton 2. During assembly, the pushbutton can easily be pushed over the housing socket 3 until the catches 36 snap into the slots 37. The pushbutton is thus retained on the housing, and the guide ridges 35 guide the pushbutton.

The two resilient side walls 41 are formed on two opposite sides of the pot-shaped pushbutton. The pushbutton itself is formed of an opaque plastic in the embodiment shown in FIGS. 1 through 4. On the front side of the pushbutton is a small window 38, through which the switch position can be visibly indicated. This is significant because the pushbutton returns to its original rest position after every actuation.

As seen in the top part of FIG. 1, a follower 18 is formed into each inner wall of the pushbutton on the two sides on which there are no side walls 41, pointing in the direction of motion. The end of the bars 18, in both the rest position and when the pushbutton is pressed down, lie in a V-shaped pockets 17 in a switch plunger 4. The switch plunger 4 is made of plastic and is U-shaped in section. It comprises a head part 12 formed onto a base part 11 and two arms 13 formed on the sides. Both arms 13 are the same length, and their free ends terminate in tapering points 16. Looked at from the side, the head part 12 is mushroom-shaped, with a domed surface 14. On this domed surface is an inscription or marking which indicates the switch position. Depending on the angular position of the switch plunger in the rest position, differing portions of this inscription or marking are visible in the window 38 of the pushbutton. Two edges 15 of the domed surface 14 are rounded and reinforced.

In the middle of the base part 11 between the two arms 13 is formed positioning pin 19, which retains a helical return spring 10.

Points 20 are formed on either side of the open ends of the V-shaped pockets 17 of the switch plunger 4. Points 20 engage the projecting elevations 28 of a switch rocker 8.

The return spring 10 is placed between the switch plunger 4 and the switch rocker 8, so that the spring is partly inserted into a blind hole 26 in the switch rocker 8, and presses against the bottom of this blind hole. This return spring is a compression spring, so it tends to push the switch plunger and the switch rocker apart.

The switch rocker 8 is injection-molded of plastic and has the shape of a two-armed lever with one short and one long arm. The short arm consists of two resilient side walls 21, which are formed separately side by side. This forms a chamber 22 open on three sides, into which the base part 11 of the switch plunger 4 fits. In addition, the return spring 10 is also placed between the two side walls 21. The side walls 21 each have, on two corners, elevations 28 pointing inward toward one another, which engage with the points 20 on the switch plunger. On their outer surfaces, the side walls each have a convex swelling 27, around which the switch rocker can pivot through a small angle.

The long arm 23 of the switch rocker tapers slightly in section towards its end, so that the switch rocker can pivot. If it had the same section throughout its length, the long arm 23 would bump against the side of the housing socket, and pivoting would be inhibited.

On both outer surfaces of its free end, the long arm 23 comprises a V-shaped knife-edge bearing 24, formed by two wedge-shaped facets 9. These facets 9, together with the knife-edge bearings, are made so as to extend laterally with respect to the long arm 23. As will be explained below, these facets 9 engage with the point 16 of the switch plunger. Between the two knife-edge bearings 24 is a recess 25 in the long arm.

Figure 3:
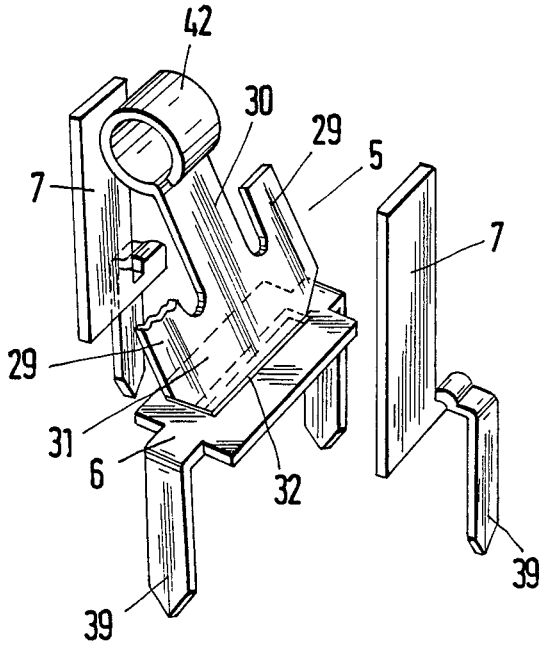
FIG. 3: a detail of the pushbutton switch in perspective view and in enlarged scale.
Figure 4:
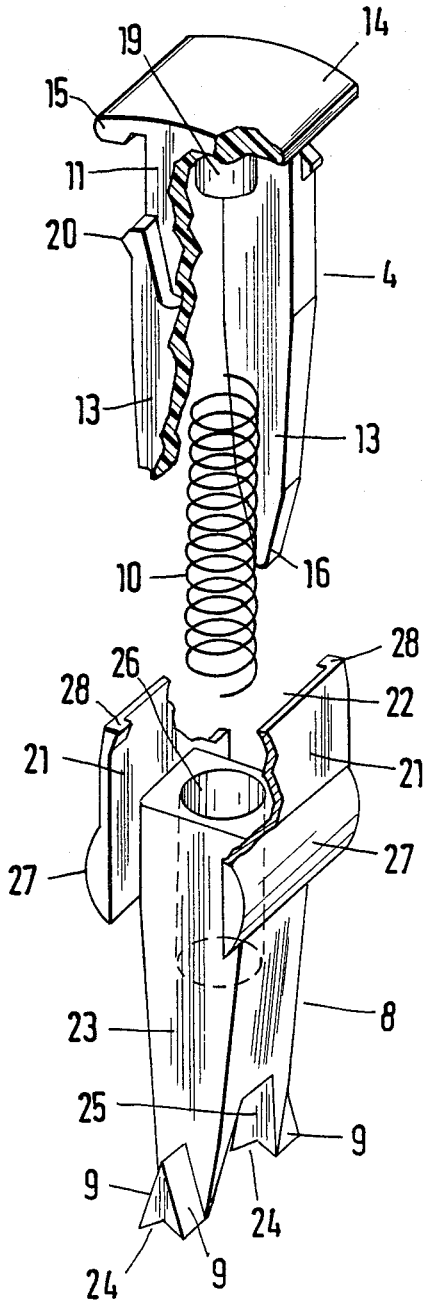
FIG. 4: a switch plunger and a switch rocker in perspective view and an enlarged scale.

Electrical contact between the fixed contacts 7 and the central contact part 6 is produced by an E-shaped contact bridge 5 made of metal. The details of this contact system are shown in FIG. 3. The contact bridge has two external snap tongues 29 and a contact torgue 30, longer than the snap tongues and placed between them, which has a tube-shaped contact element 42 at its front end. The snap and contact tongues are connected by means of a connection bar 31. As seen in FIG. 3, the contact bridge 5, together with the edge of the connection bar 31, sits in the knife-edge bearing 32 of the central contact part 6. The edge at the free end of the snap tongue 29 sits in the knife-edge bearing 24 of the contact rocker 8. The contact bridge 5 is thus clamped between these two knife-edge bearings, and is retained in an angled position due to the pretension exerted by the return spring 10. The contact tongue 30 with its contact elements 42 also projects into the recess 25 in the switch rocker 8.

Figure 2:
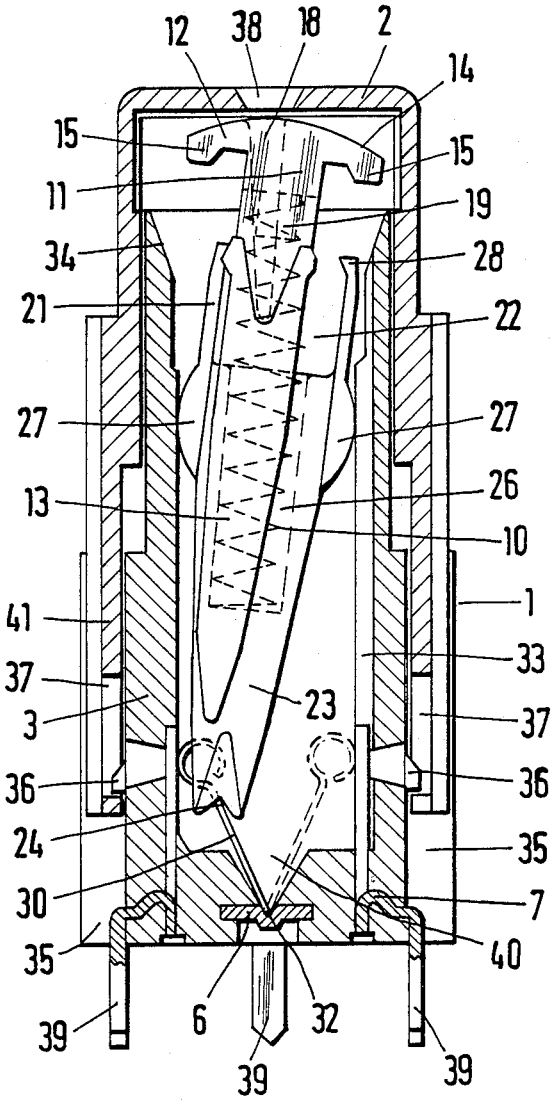
FIG. 2: a side view of the pushbutton switch in section.

As FIG. 2 shows, the housing socket 3 has a number of guide ribs 33 formed into two opposite sides of its inner surface. These guide ribs extend almost to the bottom of the housing socket. At the end near the opening, the guide ribs 33 have insert bevels 34, which taper towards their free ends. As seen in FIG. 1, in the sample embodiment illustrated in the figures there are three guide ribs on each side.

FIG. 2 shows that the switch rocker 8 with its convex projections 27 fits between the guide ribs 33 of the housing socket 3. The switch rocker can pivot about these projections through a small angle.

As already mentioned, both the switch rocker 8 and the switch plunger 4 are in a sloping position in the rest position (FIG. 2). If the pushbutton is then pushed down, the switch plunger 4 in the sloping position then moves down, urged by the bars 18, whose tips press into the bottom of the V-shaped pockets 17. Because the return spring 10 is compressed, this also increases the pressure with which the contact element 42 is pressed against the fixed contact 7. As the pushbutton is further pressed, its progressive motion causes the point 16 of the switch plunger 4 to contact either the right or the left facet 9. Further pressing of the button increases the engagement of the point 16 with respect to the facet. Finally, the edge 15 of the switch plunger 4 reaches the insert bevel 34, and when the pushbutton is depressed further, the edge 15 slides along the insert bevel 34. The exertion of a downward force by point 16 upon one side of a facet 9 causes the switch rocker 8 to pivot in a rotary manner towards the center while the switch plunger 4 is held in place by the contacting of edge 15 and insert bevel 34. The point 16 of the switch rocker 8 will then snap over from one side of facet 9 to the other side of facet 9. This causes the contact bridge to pivot about the knife-edge bearing 32, so that the tubular contact 42 is engaged with the other one of contacts 7. The sliding of the edge 15 along the insert bevels 34 and then the guide ribs 33 represents a first constraint on the motion of the switch plunger.

When the pushbutton is released, it then returns, under the pressure of the return spring, from the depressed switching position to the original rest position. The tubular contact 42, however, maintains its engagement with the other contact 7. This presses the projections 20 on the switch plunger against the projections 28 on the switch rocker, which imparts a slight torque on the switch plunger. Hence when the pushbutton is next pushed, the point 16 comes to rest on the other facet 9.

The torque exerted on the switch plunger thus represents a second constraint on the motion of the switch plunger.

The sloping position of the switch plunger in the rest position of the pushbutton makes possible an extremely simple indication of switch position. In the embodiment shown in FIGS. 1 through 4, the pushbutton is made of an opaque plastic, and there is a window 38 in the front of the pushbutton.

Figure 5:
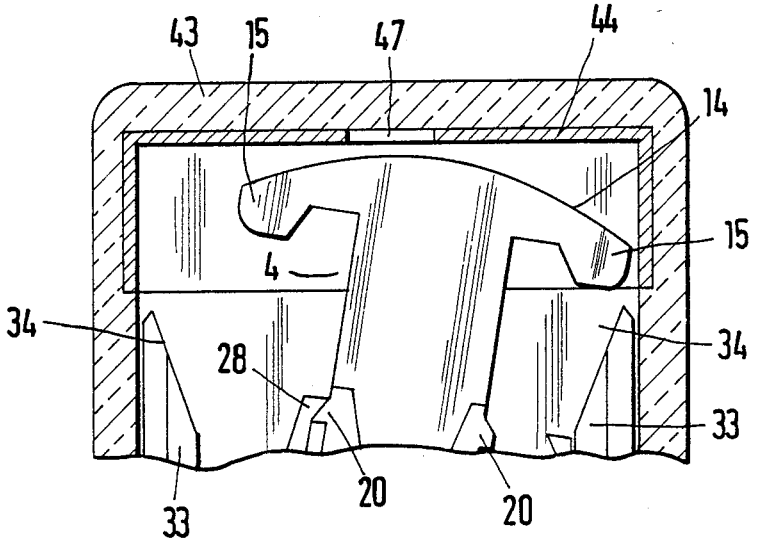
FIG. 5: another pushbutton switch, partly broken up into side views in section in enlarged scale.
Figure 6:
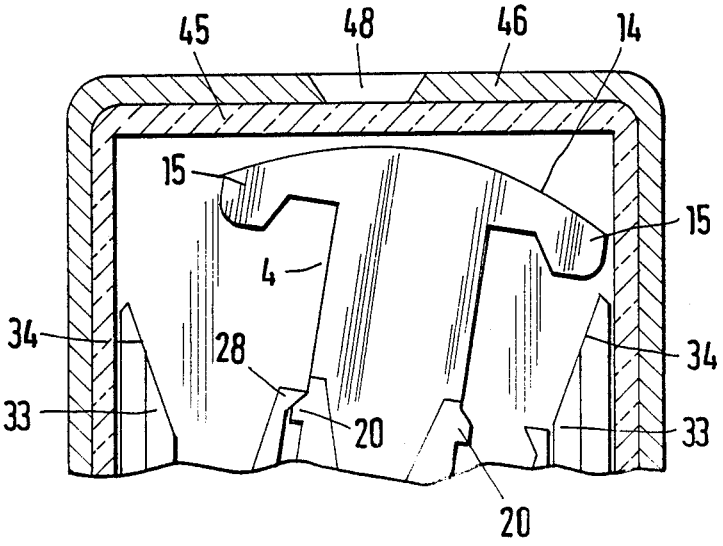
FIG. 6: another embodiment of a pushbutton switch, partly broken down into a side view in section, in enlarged scale.

FIGS. 5 and 6 show further examples of embodiments for indication of switch position. In the example shown in FIG. 5, the pushbutton 43 is made of a transparent plastic. In a depression on the inside of the pushbutton is a cover 44 made of an opaque material, which has an opening 47, through which the inscription or marking on the domed surface 14 is visible. This sample embodiment has the advantage that the housing is thick.

The pushbutton 45 in the example embodiment according to FIG. 6 is made of a transparent plastic. Over the actual pushbutton 45 is placed an additional cap 46, which has a cutout 48 on its front side. The inscription or marking on the domed surface 14 is visible through this cutout. In this sample embodiment as well, the switch housing is thick, and protected against dust and foreign particles.

We claim:

1. Pushbutton switch comprising:

a switch housing;

a pushbutton axially movable in a recess in said housing, said pushbutton movable from a rest position;

a switch plunger which is axially movable within the pushbutton and pivotable from an initial position angularly to the direction of said axial motion;

a contact assembly including two contacts, a central contact member defining a bearing and a contact bridge, which can be pivoted between said two contacts on said bearing in said central contact member, at least one of said contacts being formed by fixed electrical contact means;

a switch rocker controlling the motion of the contact bridge, mounted for pivoting between first and second positions within the switch housing and comprising at least one wedge-shaped facet for interaction with the switch plunger, such that pressure exerted on the switch plunger leads to a force on the switch rocker tending to cause it to pivot between the first and second positions;

a return spring exerting pressure between the switch plunger and the switch rocker;

characterized in that the contact bridge is engaged by the switch rocker, so that when the switch rocker is in at least one of said first and second positions, the contact bridge is urged against said electrical contact means by the return spring, so that in the rest position of the pushbutton, the switch plunger occupies a position angular to the direction of said axial motion and intermediate to said first and second positions, and in that the pivoting of the switch plunger is controlled by two means for constraint, wherein the first of said means for constraint operates as a restraint on the switch plunger during downward motion, and the second of said means for constraint operates as a restraint on the switch plunger during upward movement.

2. Pushbutton switch according to claim 1, characterized in that the switch plunger is generally U-shaped with a head part formed onto a base part and two lateral arms.

3. Pushbutton switch according to claim 2, characterized in that the switch rocker has the form of a two-armed lever with one short and one long arm, in which the short arm is made up of two projecting, separated, resilient side walls, which form a chamber open on two sides to accept the base part of the switch plunger.

4. Pushbutton switch according to claim 3 characterized in that the long arm of the switch rocker has a cross-sectional area and a free end, said cross-sectional area progressively diminishing towards the free end.

5. Pushbutton switch according to claim 4 characterized in that the free end of the long arm further comprises at least one knife-edge bearing having an outline, the contact bridge pivoting on said knife-edged bearing, the outline of said knife-edge bearing comprising a wedge-shaped member defined by paired facets.

6. Pushbutton switch according to claim 5, wherein two of said knife-edge bearings are provided and characterized by the fact that a recess is formed in said long arm between said two knife-edge bearings.

7. Pushbutton switch according to claim 2, characterized by the fact that each of the arms of the plunger comprises at least one projecting point.

8. Pushbutton switch according to claim 7, wherein the pushbutton switch further includes at least one insert bevel and at least one guide rib, said insert bevel and said guide rib comprising said first means for constraint.

9. Pushbutton switch according to claim 7, wherein said switch rocker further includes a switch rocker projection, said switch rocker projection comprising said second means for constraint.

10. Pushbutton switch according to claim 2, characterized in that the plunger comprises a pin for retaining the return spring.

11. Pushbutton switch according to claim 2 further comprising a pair of followers having ends, each said arm further comprising an outer side and a V-shaped pocket hollowed out of the outer side of said arm in the vicinity of said base part, said followers projecting into said V-shaped pockets, whereby the plunger plucts abut the ends of said followers.

12. Pushbutton switch according to claim 9, characterized in that the pushbutton further comprises an underside and the followers are projecting members extending from the underside of the pushbutton.

13. Pushbutton switch according to claim 2, characterized in that the head part comprises a domed surface with rounded edges.

14. Pushbutton switch according to claim 2 characterized in that each of the lateral arms of said U-shaped plunger further comprises a free end and ends in a point which engages with the wedge-shaped facet of the switch plunger, said lateral arms decreasing in width towards said free ends.

15. Pushbutton switch according to claim 1 wherein said second means for constraint pivots said switch plunger perpendicular to the direction of said axial motion.

16. Pushbutton switch according to claim 15, characterized in that the contact bridge is E-shaped with two parallel external snap tongues and a longer contact tongue placed between them, such that the snap tongues and the contact tongue are connected to one another through a connector bar arranged perpendicular to them.

17. Pushbutton switch comprising:

a switch housing;

a pushbutton axially movable in a recess in said housing, said pushbutton movable from a rest position;

a switch plunger which is axially movable within the push-button and pivotable angularly to the direction of said axial motion;

a contact assembly including two contacts, a central contact member defining a bearing and a contact bridge, which can be pivoted between said two contacts, on said bearing in said central contact member, at least one of said contacts being formed by fixed electrical contact means;

a switch rocker controlling the motion of the contact bridge, mounted for pivoting between first and second positions within the switch housing and comprising at least one wedge-shaped facet for interaction with the switch plunger, such that pressure exerted on the switch plunger leads to a force on the switch rocker tending to cause it to pivot between the first and second positions;

a return spring exerting pressure between the switch plunger and the switch rocker;

characterized in that the contact bridge is engaged by the switch rocker, so that when the switch rocker is in at least one of said first and second positions, the contact bridge is urged against said electrical contact means by the return spring, so that in the rest position of the pushbutton the switch plunger occupies a position angular to the direction of said axial motion and intermediate to said first and second positions, and in that the pivoting of the switch plunger is controlled by two means for constraint, the first of said means for constraint operating as a restraint on the switch plunger during donward motion and the second of said means for constraint operating as a restraint on the switch plunger during upward movement and further characterized in that the switch plunger is generally U-shaped, said switch plunger further comprising a base part, a head part formed onto said base part and two lateral arms of equal length.

18. Pushbutton switch comprising:

a switch housing;

a pushbutton axially movable in a recess in said housing, said pushbutton movable from a rest position;

a switch plunger which is axially movable within the pushbutton and pivotable from an initial position angularly to the direction of said axial motion;

a contact assembly including two contacts, a central contact member defining a bearing and a contact bridge, which can be pivoted between two contacts on said bearing in said central contact member, at least one of said contacts being formed by fixed electrical contact means;

a switch rocker controlling the motion of the contact bridge, mounted for pivoting between first and second positions within the switch housing and comprising at least one wedge-shaped facet for interaction with the switch plunger, such that pressure exerted on the switch plunger leads to a force on the switch rocker tending to cause it to pivot between the first and second positions;

a return spring exerting pressure between the switch plunger and the switch rocker;

characterized in that the contact bridge is engaged by the switch rocker, so that when the switch rocker is in at least one of said first and second positions, the contact bridge is urged against said electrical contact means by the return spring, so that in the rest position of the pushbutton, the switch plunger occupies a position angular to the direction of said axial motion and intermediate to said first and second positions, and in that the pivoting of the switch plunger is controlled by two means for constraint, wherein the first of said means for constraint operates as a restraint on the switch plunger during downward motion, and the second of said means for constraint operates as a restraint on the switch plunger during upward movement such that the switch plunger will not return to its initial position.

19. Pushbutton switch comprising:

a switch housing;

a pushbutton axially movable in a recess in said housing, said pushbutton movable from a rest position;

a switch plunger which is axially movable within the pushbutton and pivotable from an initial position angularly to the direction of said axial motion;

a contact assembly including two contacts, a central contact member defining a bearing and a contact bridge, which can be pivoted between two contacts on said bearing in said central contact member, at least one of said contacts being formed by fixed electrical contact means;

a switch rocker controlling the motion of the contact bridge, mounted for pivoting between first and second positions within the switch housing and comprising at least one wedge-shaped facet for interaction with the switch plunger, such that pressure exerted on the switch plunger leads to a force on the switch rocker tending to cause it to pivot between the first and second positions;

a return spring exerting pressure between the switch plunger and the switch rocker;

characterized in that the contact bridge is engaged by the switched rocker, so that when the switch rocker is in at least one of said first and second positions, the contact bridge is urged against said electrical contact means by the return spring, so that in the rest position of the pushbutton, the switch plunger occupies a position angular to the direction of said axial motion and intermedite to said first and second positions, and in not depicting of the switch plungers controlled by two means for constraint, the first of said means for constraint operates as a restraint on the switch plunger during downward motion, and the second of said means for constraint operating as restraint on the switch plunger during upward motion, said second means for constraint pivoting said switch plunger to a second angular switch position intermediate to said first and second switch plunger positions.

* * * * *